US007259360B2

(12) United States Patent
Sholders

(10) Patent No.: US 7,259,360 B2
(45) Date of Patent: Aug. 21, 2007

(54) BACON PACKAGE CONVERTS TO A RACK FOR COOKING BACON IN A MICROWAVE OVEN AND COLLECTING GREASE FOR DISPOSAL

(76) Inventor: Ronald Dean Sholders, 7640 SW. 168 St., Palmetto Bay, FL (US) 33157

( * ) Notice: Subject to any disclaimer, the term of this patent is extended or adjusted under 35 U.S.C. 154(b) by 176 days.

(21) Appl. No.: 11/180,246

(22) Filed: Jul. 13, 2005

(65) Prior Publication Data

US 2007/0012688 A1 Jan. 18, 2007

(51) Int. Cl.
*H05B 6/80* (2006.01)

(52) U.S. Cl. ..... 219/732

(58) Field of Classification Search ..... 219/732, 219/733, 734, 753; 99/444, 446
See application file for complete search history.

(56) References Cited

U.S. PATENT DOCUMENTS

| | | | | |
|---|---|---|---|---|
| 4,924,049 | A * | 5/1990 | Dexter, Jr. | 219/732 |
| 4,933,528 | A * | 6/1990 | Barr | 219/732 |
| 4,952,764 | A * | 8/1990 | Harrington | 219/732 |
| 5,552,585 | A * | 9/1996 | Fleck et al. | 219/732 |
| 5,714,740 | A * | 2/1998 | Kelly et al. | 219/732 |
| 5,837,979 | A * | 11/1998 | Fleck et al. | 219/732 |
| 6,211,502 | B1 * | 4/2001 | Hechler, IV | 219/732 |
| 6,448,542 | B2 * | 9/2002 | Wong et al. | 219/732 |

* cited by examiner

*Primary Examiner*—Daniel Robinson

(57) ABSTRACT

A method of packaging bacon so that after folding and joining two tabs, the package converts to a rack for holding the bacon and collecting the grease during microwave cooking.

1 Claim, 2 Drawing Sheets

BACON PACKAGE CONVERTS TO A RACK FOR COOKING BACON IN A MICROWAVE OVEN AND COLLECTING GREASE FOR DISPOSAL

CROSS REFERENCE TO RELATED APPLICATIONS

Not applicable

BACKGROUND OF THE INVENTION

Conventional cooking of bacon, whether in a skillet, on a cookie sheet in a traditional oven, or hanging on a rack for microwave cooking, always involves handling the bacon with utensils or by hand. After cooking, the utensils must then be washed.

Using a package which converts to a rack for cooking, there is no handling of the bacon.

BRIEF SUMMARY OF THE INVENTION

This invention proposes a method of packaging bacon in a uniquely designed carton which can be folded and used to hold the bacon while it is being cooked in a microwave oven. The carton and the trapped grease are then discarded together.

DETAILED DESCRIPTION OF THE INVENTION

The invention consists of a method of packaging bacon so the package itself can be converted into a rack for microwave cooking of the bacon and storage of the resultant grease until disposal.

Figure 1:
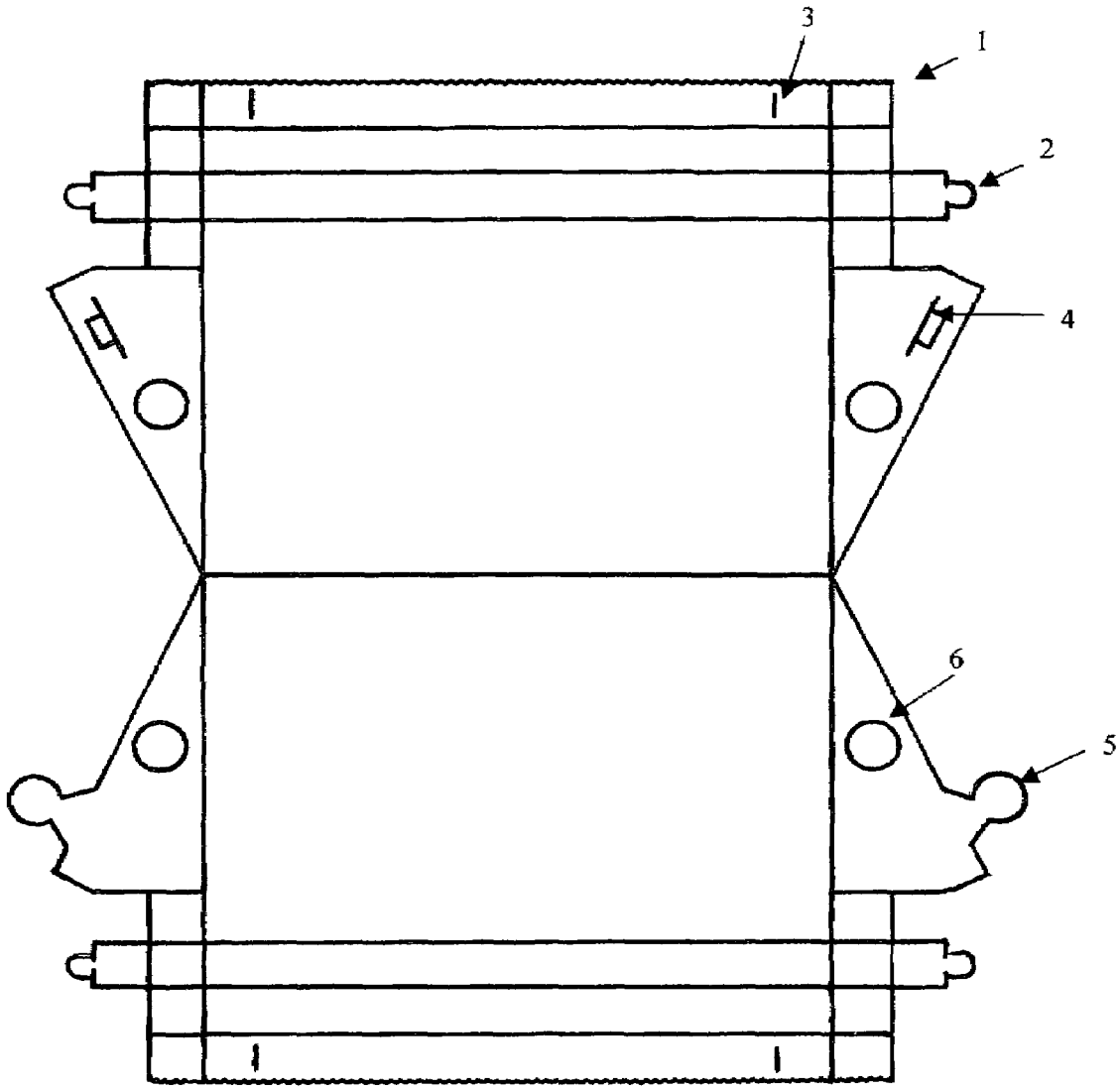
FIG. 1/2 shows the design of the carton which can be stamped out of paper or light plastic.

The device is stamped out of paper or light plastic as shown in the drawing FIG. 1/2. Where bends are needed the paper or plastic is creased at the same time. If paper is used, a light coating of wax will prevent grease bleed through. The paper or plastic can be larger or smaller depending on how much bacon is to be packaged or for large or small microwave ovens.

The manufacturer of the paper folds the ends into a box 7 and secures each end with tab 2 into slot 3, leaving a flat piece of paper with an enclosed box at each end. Then the triangular pieces on the sides are bent under, leaving a rectangular piece of paper with boxes across the ends.

The bacon supplier places the strips of bacon on the paper in the usual manner, only in this case the strips run from box to box. The bacon is wrapped in the usual cellophane material for sale.

Figure 2:
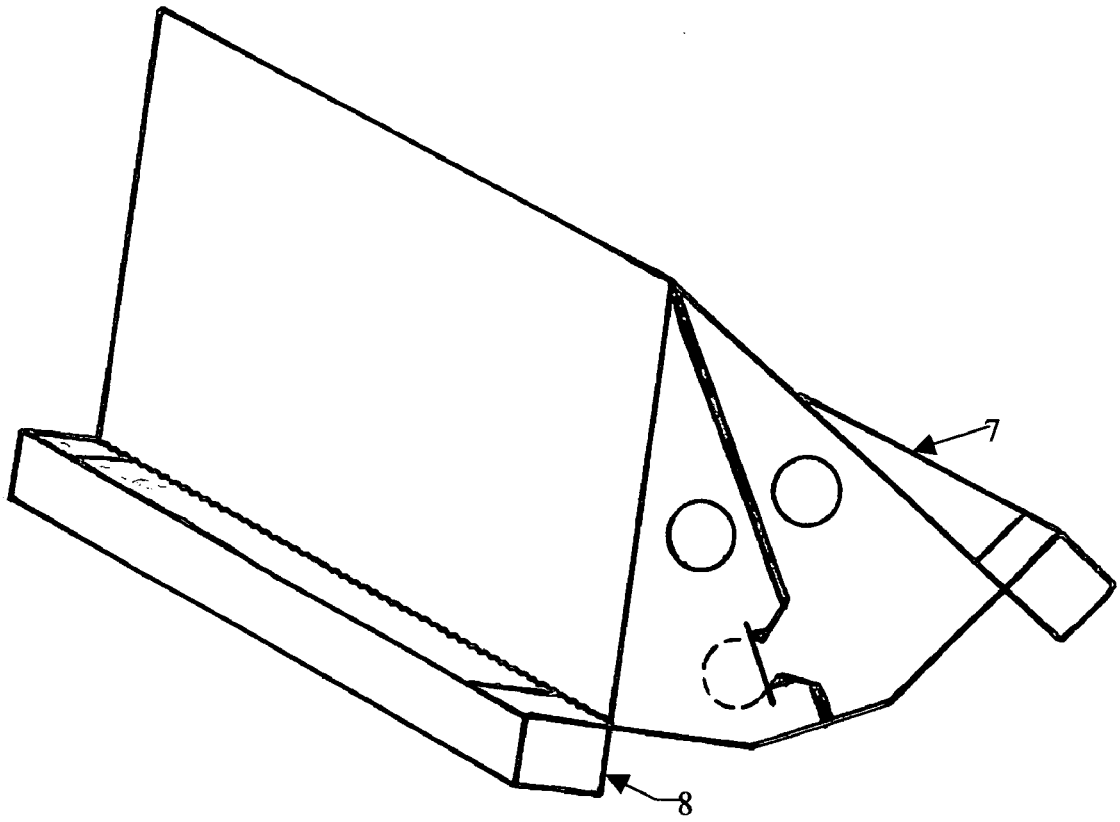
FIG. 2/2 shows the carton assembled.

The consumer removes the outer cellophane, bends the bacon and the carton into a tent shape FIG. 2/2. Then the ends of the tent are hooked together pushing the tabs 5 into slots 4 to hold the tent shape.

The tent and bacon are placed in the microwave until cooking is complete.

As the bacon cooks, grease drains down the sides of the tent, through the serrated edges of the boxes and is trapped inside the boxes.

After cooking and cooling, the tent and bacon are removed from the oven using the round finger holes 6 on each end. The bacon is removed and the paper tent and the trapped grease are discarded.

The invention claimed is:

1. An apparatus made from the package that bacon is distributed in converts to a device for holding the bacon and trapping the grease during microwave cooking, comprising:

a. Standard poster paper, 100 lb. more or less, is coated with wax and stamped on a machine which cuts it to a unique pattern; the paper can be coated with a reflective non-metal surface to enhance cooking;

b. The paper is further modified by stamping to form cut-outs for tabs and to dent the paper to help it fold in the correct manner;

c. The paper is folded by turning the tabs, along with the slotted triangular wings on the sides, down and under; the ends of the paper, which now resembles a rectangle, are then bent upwards, horizontally and then down to form boxes at each end which are fastened together using the tab and slot;

d. The bacon is placed on the package in the usual manner by the meatpacker, with bacon strips running perpendicular to the boxes on each end;

e. The package is then wrapped in a clear wrapping in the normal manner for distribution;

f. The consumer removes the outer wrapping, folds the boxed sides down to form a tent-like structure with a box at the bottom of each of the sloping sides; the bacon is automatically draped over the slanted sides during this maneuver;

g. The wings with the tabs and slots, which were folded under during manufacturing, are unfolded and the tabs and slots are engaged to hold the structure in a tent shape;

h. The holes on each end of the tent are for the insertion of the fingers to facilitate placing the apparatus into or out of the microwave;

i. The boxes collect the grease as it runs down the sloping sides of the tent; the grease enters the boxes trough serrations in the box which is in contact with the sloped surface.

* * * * *